US006523220B1

(12) United States Patent
Lynn

(10) Patent No.: US 6,523,220 B1
(45) Date of Patent: Feb. 25, 2003

(54) COLLECTION/DISPENSING SYSTEM WITH IMPROVED MOPPING ASSEMBLY

(76) Inventor: William R. Lynn, 38 Prospect St., Dover, NH (US) 03820

( * ) Notice: Subject to any disclaimer, the term of this patent is extended or adjusted under 35 U.S.C. 154(b) by 192 days.

(21) Appl. No.: 09/685,837

(22) Filed: Oct. 10, 2000

(51) Int. Cl.[7] ..... A47L 13/14; A47L 13/58

(52) U.S. Cl. ..... 15/261; 15/262; 15/263; 15/264; 15/228; 15/229.2; 15/244.1; 68/271; 68/22 A

(58) Field of Search ..... 15/228, 229.2, 15/244.1, 261, 262, 263, 264; 100/131, 132, 133, 134, 125; 134/6; 68/24, 271, 22 A

(56) References Cited

U.S. PATENT DOCUMENTS

| | | | | | |
|---|---|---|---|---|---|
| 4,161,799 | A | * | 7/1979 | Sorrells | 15/260 |
| 5,448,865 | A | * | 9/1995 | Palmersten | 52/309.9 |
| 5,983,441 | A | * | 11/1999 | Williams et al. | 15/260 |
| 6,260,230 | B1 | * | 7/2001 | Hunt | 134/6 |
| 6,279,195 | B1 | * | 8/2001 | Biggs | 15/260 |

* cited by examiner

*Primary Examiner*—Robert J. Warden, Sr.
*Assistant Examiner*—Shay L Balsis
(74) *Attorney, Agent, or Firm*—Davis & Bujold, P.L.L.C.

(57) ABSTRACT

A mopping system for facilitating mopping of a desired surface to be cleaned. The mopping system comprising a base framework supporting a fluid dispensing container and a fluid collection container. The mopping system further including a wringing mechanism supported by the base framework, and the wringing system is coupled to the fluid dispensing container for receiving a cleaning fluid therefrom and facilitate cleaning of a mopping assembly when located within the wringing mechanism. The wringing mechanism is coupled to a collection container for conveying collected fluid from the wringing mechanism to the collection container. A filter is located, between the wringing mechanism and the collection container, to filter the fluid wrung from the mopping assembly prior to discharge the wrung fluid in the collection container. The positions of the collection container and the dispensing container can be reversed, once the collection container is substantially full of collected fluid. The mopping assembly comprises an elongate handle with a hand grip at one end and a cleaning pad located at the opposite end thereof. The cleaning pad comprises both an absorbent material and a non-absorbent material. The cleaning pad has a plurality of drainage channels formed therein to facilitate removal of liquid and debris from the surface to be cleaned, and the draining channels are at least partially defined by the non-absorbent material.

13 Claims, 8 Drawing Sheets

COLLECTION/DISPENSING SYSTEM WITH IMPROVED MOPPING ASSEMBLY

FIELD OF THE INVENTION

The present invention relates to a dispensing/collection system with an improved mopping assembly having drainage channels which facilitate drainage of any absorbed liquid and debris from the mop assembly during a wringing procedure.

BACKGROUND OF THE INVENTION

While there are currently available a number of cleaning systems which facilitate cleaning of a surface, none of the available systems are directed at providing a cleaning system which facilitates removal of substantially all of the absorbed liquids in the debris from the mop head as well as removal of a desired amount of the applied liquid from the surface to be cleaned. Moreover, none of the currently available systems are designed to channel the absorbed liquid and debris from the cleaning pad during a wringing procedure.

In particular, many of the prior art cleaning systems utilize a single fluid or solution which serves both as the cleaning fluid as well as the rinsing fluid. Accordingly, over a relatively short period of time, the cleaning pad, once rinsed in the single fluid or solution, has a tendency to reabsorb some of the removed dirt, grease, wax, oil, and other debris, from in the single cleaning fluid or solution, and redeposits of the removed dirt, grease, wax, oil, and other debris back onto the surface to be cleaned. In addition, it is often difficult for an operator to determine how many wash/rinse cycles of the cleaning pad can occur before the single fluid or solution is discarded and replaced with the new cleaning solution.

A further problem with prior art cleaning systems is that the wringing mechanism is not capable of receiving a separate supply of rinsing solution to rinse the cleaning pad and the wringing mechanism also does not facilitate regulation of the wringing pressure, applied to the mop head, to allow control of the amount of liquid squeezed from or reabsorbed by the cleaning pad 2 upon release of the wringing mechanism-this liquid may thereafter be applied to the surface to be cleaned.

Another associated problem is the fact that it is also difficult for an operator to control the amount of moisture being left on the surface to be cleaned, following mopping of the surface with the cleaning pad, due to the erratic pressures applied by various operators while utilizing the wringing mechanism. It is to be appreciated that the amount of moisture remaining of the surface to be cleaned may create a safety concern, especially on a floor or surface which become slippery when wet.

Due to the above noted as well as other associated factors, it is difficult for an operator to clean any desired floor, surface, room, area, etc. in a uniform manner. In particular, depending on the specific operator using the cleaning equipment, various degrees of moisture can be applied or removed from the surface to be cleaned and varying amounts of removed dirt, oil, grease and/or other debris can be removed from the surface to be cleaned during a cleaning process.

Lastly, most conventional mops, sponges, rags, etc., are designed to maximize absorption of fluid, liquid and debris but are not designed to release the absorbed fluid, liquid and other debris during a wringing or cleaning process.

Due to the above noted drawbacks associated with the prior art mopping systems, wringing systems, and/or cleaning systems, the surface to be cleaned is generally re-contaminated, after only one or a couple of rinse cycles of the cleaning pad because the same source of fluid is used both to supply the cleaning fluid to the surface to be cleaned as well as to remove the dirt, grease, wax, oils and other debris from the surface to be cleaned.

SUMMARY OF THE INVENTION

Wherefore, it is an object of the present invention to provide a cleaning/dispensing system which overcomes the above noted drawbacks of the prior art systems.

Another object of the present invention is to provide a mop head which comprises both a non-absorbent material as well as an absorbent material and is provided with a plurality of drainage channels which facilitate drainage of any absorbed liquid and debris from the absorbent material.

A further object of the present invention is to provide a versatile dispensing/cleaning system which facilitates dispensing of a desired cleaning solution to the mop head, during a wringing process, and also facilitates collection of the liquid and debris, wrung from the mop head during the wringing process, in a collection container to facilitate re-use of the collected liquid.

Yet another object of the present invention is to filter the liquid, squeezed from the cleaning pad during the wringing process, prior to collecting the same in the collection container, to facilitate recycling and reuse of the squeezed and collected liquid.

A still further object of the present invention is to rigidly support the absorbent material, via a support structure of the mopping assembly, to facilitate application of a desired contact pressure of the absorbent material, against the surface to be cleaned, as the absorbent material engages with the surface to be cleaned to maximize the cleaning thereof.

A further object of the present invention is to provide a dispensing/cleansing system which is relatively compact and can be readily utilized by a single operator.

Another object of the invention is to provide two separate containers, a first container for housing a cleaning solution and a second container for housing liquid and debris removed from the surface to be cleaned separately from the cleaning solution to minimize, as much as possible, re-contamination of the surface being cleaned.

Yet another object of the present invention is to provide a mechanism for controlling a flow rate of the cleaning solution supplied to the wringing mechanism, during the rinse procedure, to more effectively remove dirt, grease, oil, wax and other debris from the cleaning pad during the wringing procedure.

A further object of the present invention is to provide a mechanism for filtering of the liquid, collected during the wringing process of the mop head, to adequately clean that liquid and facilitate reuse of the collected liquid for further cleaning of the surface to be cleaned or rinsing of the cleaning pad during the rinse procedure.

Still another object of the present invention is to provide a pressure control device, for the wringing mechanism, so that the amount of wringing pressure applied to the cleaning pad by an operator, during the wringing process, can be precisely controlled, each time the cleaning pad is wrung, and thereby facilitate improved control of the amount of moisture reapplied to the surface to be cleaned and result in a more uniform cleaning of the surface being cleaned.

Yet another object of the present invention is to provide a mechanism for controlling the entrance location where the cleaning fluid is applied to the cleaning pad, during the wringing procedure, to facilitate maximum cleaning of the cleaning pad during the wringing process.

A further object of the present invention is to design an improved cleaning pad which has an arrangement such that the absorbent material and nonabsorbent materials are combined with one another to define a plurality of elongate drainage channels which facilitate drainage of any absorbed liquid and debris from the cleaning pad during the wringing process.

Another object of the present invention is to incorporate desired polymers and prepolymers in the cleaning pad which are specifically design to absorb a maximum amount of liquid from the surface to be cleaned and to readily release this absorbed liquid once a sufficient pressure is applied to the cleaning pad, during the wringing procedure, and thereby facilitate more precise control over the amount of moisture being re-applied and/or removed from the surface being cleaned.

Still another object of the present invention is designed a cleaning pad which has a desired exterior surface texture to facilitate applying a desired scrubbing action to the surface being cleaned.

Yet another object of the present invention is to provide a cleaning system which facilitates leaving additional moisture on the surface to be cleaned, when cleaning during nighttime, for example, to facilitate "deep" cleaning of the surface to be cleaned while also providing a cleaning system which facilitates removing a maximum amount of moisture from the surface being cleaned, when cleaning during daytime, to adequately dry the surface and minimize the possibility of an individual slipping on the surface being cleaned following cleaning.

A further object of the present invention is to provide a wringing system which facilitates control overeat amount of liquid and/or debris removed from the cleaning pad to customize the cleaning efficiency of the system.

BRIEF DESCRIPTION OF THE DRAWINGS

The invention will now be described, by way of example, with reference to the accompanying drawings in which.

DESCRIPTION OF THE PREFERRED EMBODIMENT(S)

Figure 1:
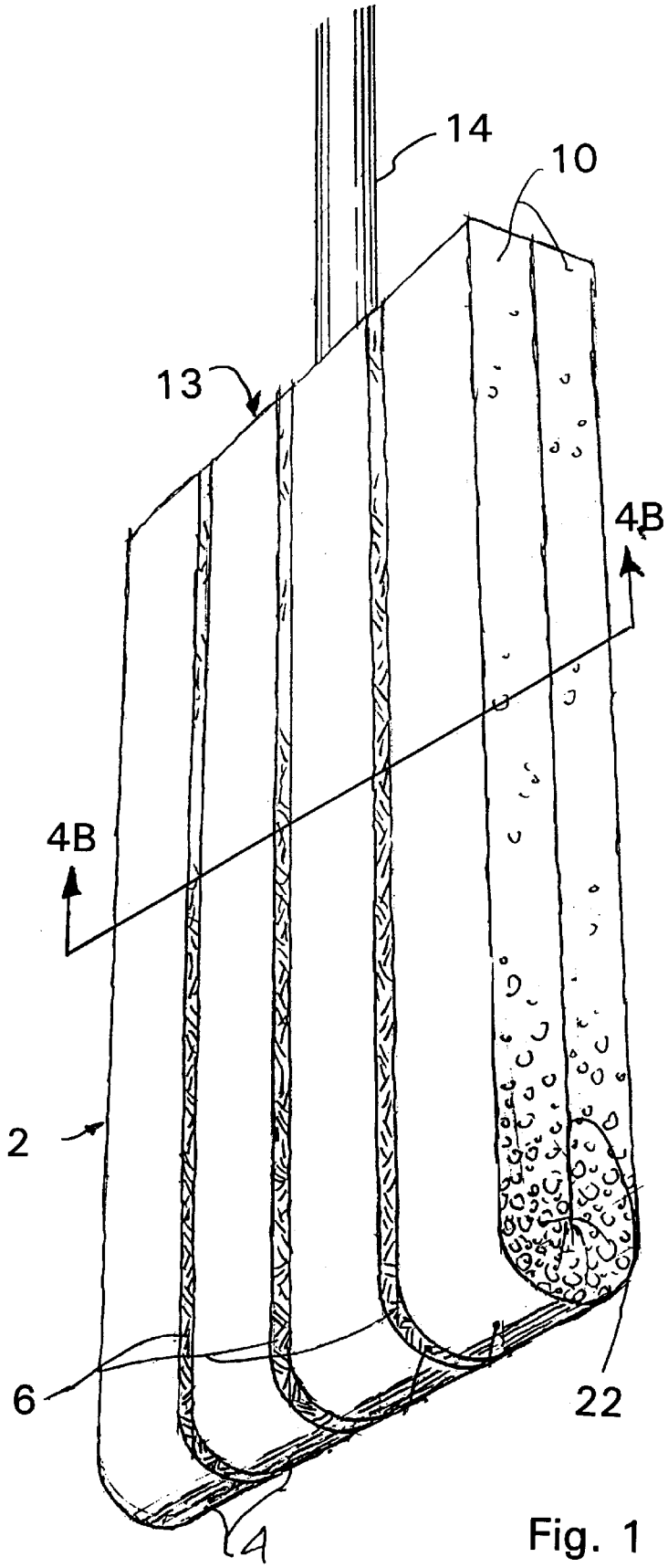
FIG. 1 is a diagrammatic perspective view of an cleaning pad, according to the present invention, shown without a remainder of the associated mopping assembly.
Figure 1A:
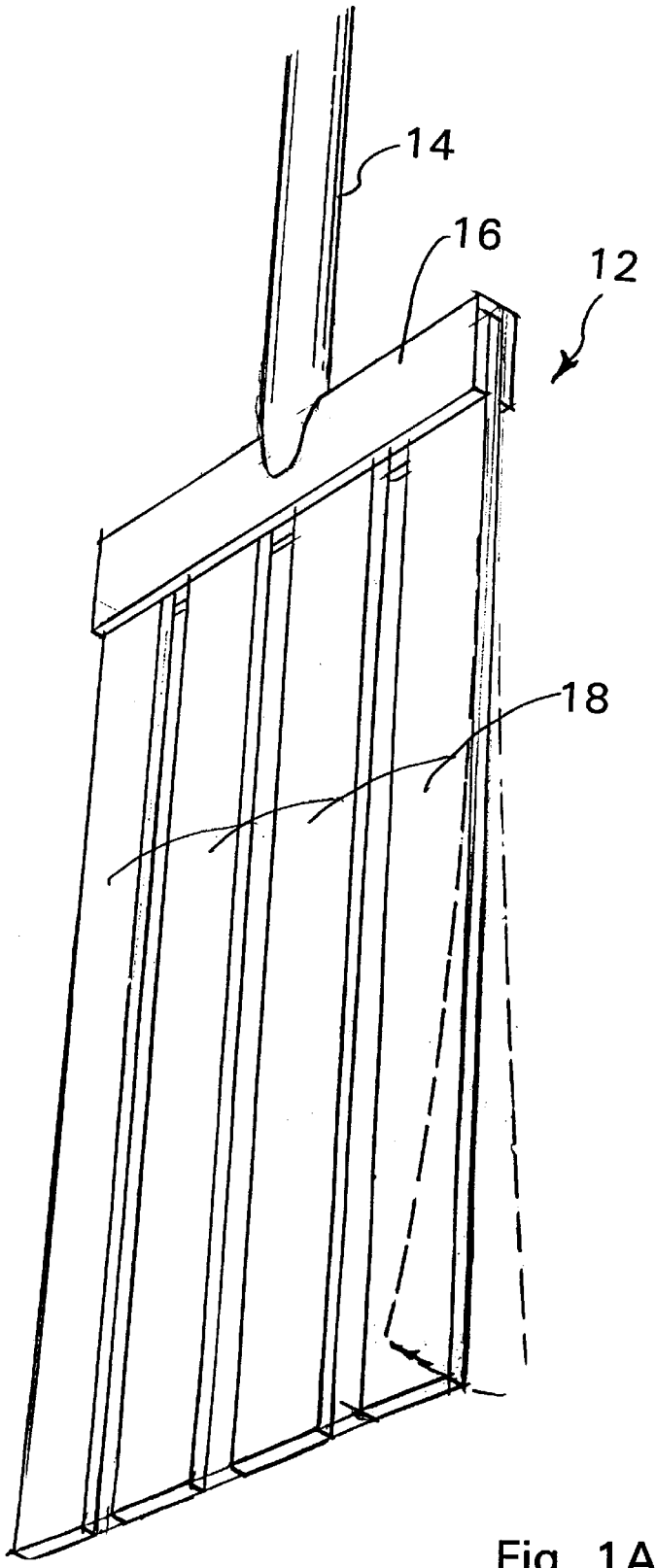
FIG. 1A is a diagrammatic perspective view of mop handle structure for use with the cleaning pad of FIG. 1.
Figure 1B:
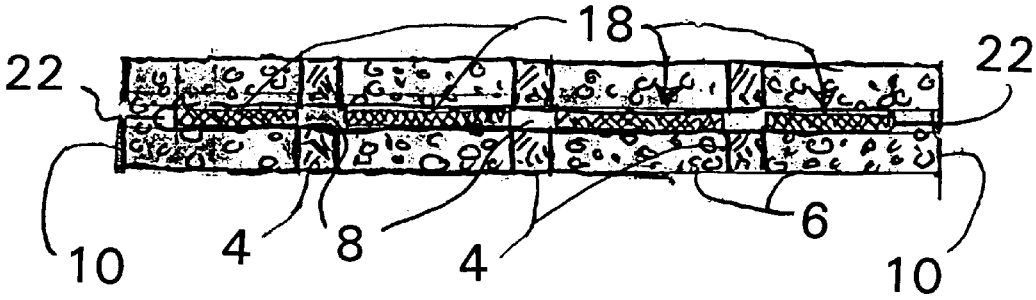
FIG. 1B is a diagrammatic cross section view along section line 1B—1B of FIG. 1 showing the cleaning pad engaged with the mop handle structure to form the mopping assembly according to the present invention.

Turning first to FIGS. 1–1B, a brief description concerning a mop assembly, according to the present invention, will now be discussed. As can be seen in those FIGS., this embodiment of the mop assembly 12 first comprises a cleaning pad 2 which comprises elongate strips of a non-absorbent material 4, such as nylon, polyester, polypropylene, etc., as well as elongate strips of an absorbent material 6, such as cotton, wool, linen, sponges, etc. According to this embodiment, a layer of non-absorbent material 4 is located between adjacent layers of absorbent material 6 and cleaning pad 2 is a generally U-shaped member and has a small opening 13 is defined by space between the adjacent legs of the U-shaped member. The non-absorbent material 4 is permanently secured to the absorbent material 6, e.g. by gluing, adhesion, stitching, etc., so that the strips of non-absorbent material and absorbent material 4, 6 form a the cleaning pad 2.

As can be seen in FIG. 1A, the outwardly facing legs of each opposed exposed absorbent material 6 of the U-shaped cleaning pad 2 is closed by an elongate seam 22 which runs along the entire length of the U-shaped cleaning pad 2 and permanently connects the opposed legs 10 to one another. The opposite side of the U-shaped cleaning pad 2 is also suitably seamed so as to define an internal pocket for receiving the support fingers 18 of the mopping assembly and preventing the support fingers 18 from being inadvertently dislodged from its desired engagement with the U-shaped cleaning pad 2 during use of the mopping assembly 12.

The non-absorbent material 4, along with the absorbent material 6 and the support fingers 18, assists with defining a plurality of drainage channels 8. The plurality of drainage channels 8 facilitate drainage of any absorbed liquid and debris, absorbed by the absorbent material 6, into a collection container 42, and a further detailed discussion concerning the same will follow. It is to be appreciated that a sufficient number of drainage channels 8 must be provided to facilitate removal of a sufficient quantity of any absorbed liquid and debris from the absorbent material 6 into collection container 42. When the non-absorbent material 4 and the absorbent material 6 are sufficiently squeezed by a mating pair of pressure rollers, for example, the absorbed liquid and debris will flow laterally along the absorbent material 6, and also laterally along the non-absorbent material 4, into and along the length of the drainage channels 8. Once the absorbed liquid and debris communicates with the drainage channels 8, the absorbed liquid and debris can readily flow out of the aperture at the end of each drainage channels 8 into or toward the collection container 42 where the absorbed liquid and debris are collected for recycling or proper disposal. The drainage channels 8 increase the removal speed and rate of transferring the absorbed liquid and debris from the absorbent material 6 to the collection container 42.

The inventors have determined that unless a sufficient amount of drainage channels 8 are provided to channel any absorbed liquid and debris away from the absorbent material 6 into a collection container 42, prior to allowing the absorbent material 6 to re-expand, the absorbent material 6 will not be as sufficiently rinsed or dried and thus a greater amount of the absorbed liquid and debris may tend to be redeposited back on a surface being cleaned during the next cleaning operation of the mopping assembly 12. However, in the event that a sufficient amount of drainage channels 8 are provided and if sufficient squeezing pressure is applied to the non-absorbent material 4 and the absorbent material 6, a majority of the absorbed liquid and debris can be readily removed from the absorbent material 6 so that the absorbent material 6, following a squeezing process, is readily able to recollect additional liquid and debris from the surface to be cleaned upon a further pass of the cleaning pad 2 over the surface. A further details description concerning the squeezing process will follow.

The drainage channels 8 each preferably have a cross-section area of about 0.25 square inches, and more preferably have an area of about a 0.04 to 0.08 square inches.

The mopping assembly 12 further comprises a handle 14 having a handle grip (not shown) at a remote free end thereof and a T-shaped head 16 located at the opposite end thereof. A plurality of rigid support fingers 18 each have one end thereof connected to and supported by the T-shaped head 16 while the opposed end of each of the support fingers 18 extends along a longitudinal axis of the mopping assembly 12. In order to attached the U-shaped cleaning pad 2 to the mopping assembly 12, the support fingers 18 pass through the opening 13 and slide along the inner surface of the U-shaped cleaning pad 2. The support fingers 18 are located to provide rigidity to the cleaning pad 2, especially the absorbent material 6, during use of the mopping assembly 12.

As can be seen in FIG. 1B, the plurality of drainage channels 8 are defined by a pair of adjacent support fingers 18 as well as overlapped sections of the non-absorbent material 4. These drainage channels 8 facilitate release and channeling of any absorbed liquid and debris from the absorbent material 6 out through the aperture into a desired collection container 42, and a further detailed discussion concerning the same will follow.

As can be seen in FIG. 1A, four support fingers 14 are provided and each one of the support fingers 18, as can be seen in FIGS. 1B–4B; is sandwiched between overlapped portions of the absorbent material 6. It is to be appreciated that the number of support fingers 18 can vary from application to application, as would be apparent to those skilled in this art. The support fingers 18 render the U-shaped cleaning pad 2 more rigid and facilitate applying a sufficient cleaning At, pressure of the absorbent material 6 against the surface to be cleaned so that the absorbent material 6 can provide a sufficient abrasive contact pressure to the surface to be cleaned as well as remove dirt, grease, wax, oil, and other debris from the surface to be cleaned.

Figure 2:
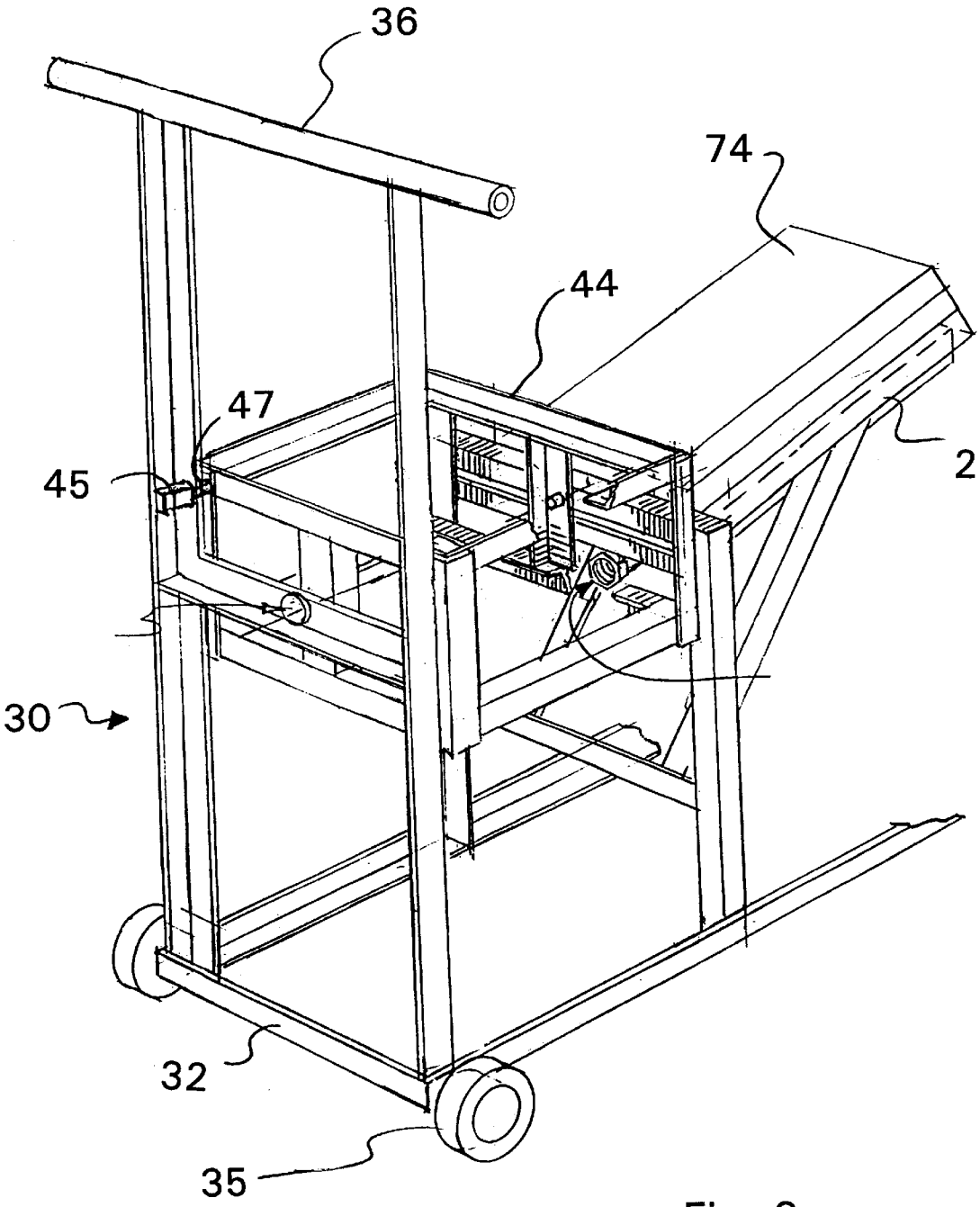
FIG. 2 is a diagrammatic partial perspective view showing a support structure for a collection/dispensing system according to the present invention.
Figure 3:
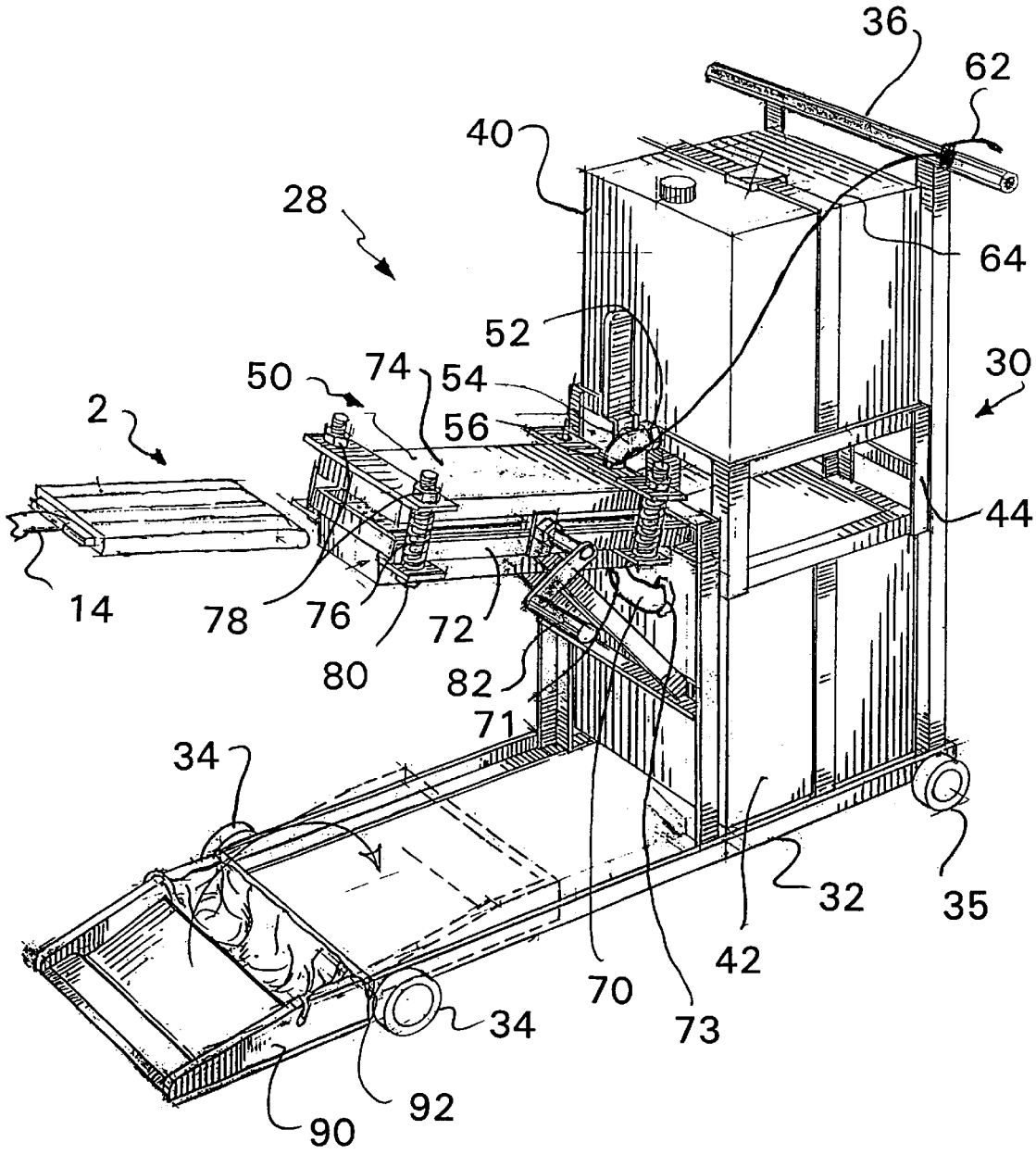
FIG. 3 is a diagrammatic perspective view showing the additional components, attached to support structure, to form the collection/dispensing system according to the present invention.

With reference now to FIGS. 2 and 3, a collection system, for use with the mopping assembly, according to the present invention, will now be discussed in detail. As can be seen in these FIGS., the dispensing/collection system 28 generally comprises a support structure 30 which has a base framework 32 for supporting the various components of the dispensing/collection system squeeze plate 28 of the present invention. The entire dispensing/collection system 28 is supported by a front set 34 and a rear set of rotatable rollers or wheels 35 which facilitate rolling motion of the dispensing/collection system 28 along a desired surface. According to a preferred form of the present invention, at least the front pair of the wheels 34 is pivotable or steerable to facilitate maneuvering of the dispensing/collection system 28 during operation.

The base framework 32 supports a transverse handle 36 which is provided to facilitate maneuvering of the dispensing/collection system 28 by an operator. The transverse handle 36 is located so that the operator can readily grab the handle 36 with his or her hands and steer the dispensing/collection system 28 as desired.

The dispensing/collection system 28 further comprises a dispensing container 40 and a collection container 42. The dispensing container 40 and the collection container 42 are both attached to a central framework 44 which is pivotably connected to the remainder of the base framework 32 of the dispensing/collection 28 preferably by a bearing (not shown) to facilitate rotation of the central framework 44. A releaseable latch mechanism 45, or some other known conventional releaseable locking arrangement, is provided for locking the central framework 44 to the remained of the base framework 32 to preventing undesired rotation of the central framework 44. The releaseable latch mechanism 45 is a spring biased pin that is supported by the base framework 32 and a remote end of the pin engages with a hole or recess 47 formed in the central framework 44. Such engagement preventing undesired rotation of the central framework 44 relative to the base framework 32.

The central framework 44 of the dispensing/collection system 28 facilitates simultaneous rotation, over an angle of 180°, of the dispensing container 40 and the collection container 42 so that the two containers reverse positions with one another. That is, following rotation, the dispensing container 40 occupies of the position previously occupied by the collection container 42 and the collection container 42 occupies of the position previously occupied by the dispensing container 40. Prior to being able to rotate the central framework 44, the releaseable latch mechanism 45 must be disengaged from the hole or recess 47 of the central framework 44.

According to a preferred form of the invention, a collection fluid will be added to the dispensing container 40 and used to supply a cleaning fluid to the wringer mechanism 50 which is used to clean the mopping assembly. A first end 52 of the supply conduit 54 is connected to an outlet of the dispensing container 40, in a fluid tight manner, while an opposite end 56 of the supply conduit 54 is connected to an upper region of the wringer mechanism 50, in a fluid tight manner. A valve 60 (not shown) is located in the supply conduit 54 to control the flow rate of the cleaning fluid from the dispensing container 40 to the wringer mechanism 50. A conventional handbrake 62, connected to the flow valve by conventional cabling 64, is utilized to facilitate remote actuation of the flow valve 60 located in the supply conduit 54 by an operator, when desired. That is, when the operator depresses the handbrake 62, the cable 64 biases the valve into an open position, in a conventional manner, to allow the flow of liquid along the supply conduit 54 to the wringing mechanism 50. When the operator releases the handbrake 62, the cable 64 allows the valve to return to its normally closed position and prevent the flow of liquid along the supply conduit 54 past the valves 60. This valve/hand brake arrangement allows an operator to remotely control of the flow valved of liquid along the supply conduit 54 to the wringing mechanism 50.

The dirty fluid resulting from cleaning of the mopping assembly 12, containing the removed dirt, grease, wax, oil, and other debris, is then channeled by a drainage conduit 70 into the collection container 42 but passes through a filter 81 to filter the dirty fluid prior to depositing that fluid in the collection container 42. Once the dispensing container 40 has completely substantially dispensed its entire fluid contents, the releaseable latch mechanism 45 is operated to allow unrestricted rotation of the central framework 44 so as to simultaneously rotate 180° both the dispensing container 40 and the collection container 42 so that the collection container 42 is now located adjacent the handle 36 while the dispensing container is now located adjacent the wheels 34, 35 base of the dispensing/collection system 28. Thereafter, the fluid contained within the collection container 42 is utilized to supply a rinsing/cleaning fluid to the wringer mechanism 50 and the supplied fluid is then wrung from the mopping assembly 12, during a wringing process, and filtered, by the filter 81, prior to being channeled by the drainage conduit 70 into the dispensing container 40—which is now functioning as the collection container 42. This procedure is repeated as necessary or desired until it is determined, by the operator, that the fluid of the dispensing/collection system 28 is sufficiently dirty or contaminated to justify disposal of the same and replenishing the dispensing/collection system 28 with a fresh supply of cleaning fluid.

The wringer mechanism 50, of the dispensing/collection system 28, facilitates squeezing the cleaning pad 2 of the mopping assembly 12 to remove a substantial portion of the absorbed dirt, grease, wax, oil, and other debris from the absorbent material 6 and the non-absorbent material 4. The wringer mechanism 50 comprises a pair of opposed pressure plates 72, 74 which are spaced from one another by a sufficient distance to allow the cleaning pad 2 of the mopping assembly 12 to be readily received therebetween, e.g. the pair of opposed pressure plates 72, 74 are spaced apart from one another by a distance of between at least about 2 inches or so to about 8–9 inches or so. One of the opposed pressure plates 72 is preferable fixedly attached to the base framework 32 while the other pressure plate 74 is movable or pivotal relative to the fixed pressure plate 72. Preferably pair of pressure plates 72, 74 are spring biased away from one another by a plurality of springs 76, e.g. four springs. As can be seen in FIG. 9 of the drawings, four nuts 78 and associated bolts 80 are utilized to couple the two opposed plates 72, 74 to one another and allow limited relative movement to and from movement therebetween. The springs 76 apply a biasing force to maintain the pair of opposed pressure plates 72, 74 in a desired spaced relationship from one another to facilitate receipt of the cleaning pad 2 during the wringing process.

The wringer mechanism 50 includes a hand crank mechanism 82 which is designed to be easily turned by the operator and to facilitate applying a desired biasing force, e.g. by a conventional rack and pinion arrangement (not shown), to at least one of the opposed pressure plates 72, 74 to force the movable plate 74 toward the fixed plate 72 and apply a sufficient squeezing force to the cleaning pad 2 of the mopping assembly 12 when located between the two opposed plates 72, 74. This relative motion of the opposed pressure plates 72, 74 applies a squeezing pressure to the cleaning pad 2 of the mop assembly 12 and the absorbed dirt, grease, wax, oil, and other debris are squeezed from the cleaning pad 2 and flow, via gravity, along the plurality of drainage openings or passages (not shown) provided in the lower fixed pressure plate 72.

Figure 7:
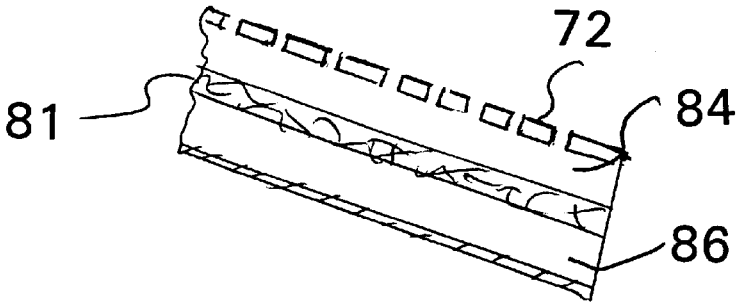
FIG. 7 is a partial diagrammatic cross sectional view showing the separation chamber of the wringing mechanism.

The first pressure plate 72, of the wringer mechanism 50, is preferably a perforated plate (see FIG. 7) having a plurality of holes, apertures or passages therein which facilitate drainage of any removed liquid, dirt, grease, wax, oil, and other debris from the cleaning pad 2 into a lower region of the wringer mechanism 50. A planar filter 81 divides a separation chamber into an upper chamber 84 and a lower chamber 86. The removed liquid, dirt, grease, wax, oil, and other debris which passes through the perforated plate 72 flows into the upper chamber 84 and is deposited on the filter 81 and the solids and other debris which can not pass through the filter 81 collects on the top surface of the filter 81. The fluid which passes through the filter member is at least partially cleaned and then partially cleaned fluid and collects in the lower chamber and then flows, via gravity, along the drainage conduit 70 into the collection container 42 where this fluid is finally collected.

A first end 71 of the drainage conduit 70 is connected to an outlet of the lower chamber of the wringer mechanism 50, in a fluid tight manner, while an opposite end 73 of the drainage conduit 70 is connected to an inlet of the collection container 42, in a fluid tight manner. The connection of the drainage conduit 70 to the collection container 42 is a releasable connection to facilitate rotation so that the dispensing container 40 can occupy the position of the collection container 42 and vice versa.

When rotation of the central framework 44 is desired, to reverse the positions of the dispensing container 40 with the collection container 42 or vice versa, the second end of the drainage conduit 70 is disconnected the collection container 42 and the second end of the supply conduit 54 is disconnected the dispensing container 40. Thereafter, the releaseable latch mechanism 45 is disengaged from the hole or recess 47 in the central framework 44 and the positions of the dispensing container 40 with the collection container 42 are reversed with one another. Next, the releaseable latch mechanism 45 again re-engages with a second hole or recess 47 of the central framework 44 to prevent further relative rotation. Finally, the second end 73 of the drainage conduit 70 is then connected with the dispensing container 40 while the first end 52 of the supply conduit 54 is connected to the collection container 42. Thereafter, the dispensing/collection system 28 can be operated as described above.

When it is necessary to completely replace the water, any fluid contained in either the dispensing container 40 or the collection container 42 is discarded into a drain or some other suitable collection device. If desired, both the dispensing container and the collection container 42 can be flushed with fluid prior to adding a cleaning fluid to the dispensing container 40. To facilitate cleaning of the dispensing container 40 and the collection container 42, both containers can either be completely removed from the central framework 44 or a small conventional valve can be provided in the lower portion of each one of those containers 40, 42 to facilitate drainage of any remaining fluid contained therein. As such teaching is conventional and well known in the art, a further detailed description concerning the same is not provided.

If desired, a front portion of the base frame can support a pivotable dust pan 90, as can be seen in FIG. 3. The dust pan 90 is pivoted along the leading edge, by conventional hinge 92 that has both a storage position, shown in dashed lines, as well as an in use position, shown in solid lines, where a leading edge of the dust pan 90 is in engagement with the surface to be cleaned to allow any solid contents which are on the surface to be cleaned swept into the dust pan and held in a holding area thereof. The leading edge of the dust pan 90 is provided with a rubber elongate strip which provides a good sealing engagement between the leading edge of the dust pan and the surface to be cleaned to ensure that the majority of the liquid and other debris is conveyed along the inclined surface of the dust pan 90 into the storage area. If desired, the dust pan 90 can be releasably attached to the base framework 32 to facilitate emptying of the dust pan when desired.

An important aspect of the present invention is to utilize a conventional super-absorbent polymer as the absorbent material 6. The super-absorbent polymer can be engineered to release a desired amount of absorbed moisture from the cleaning pad 2 when subjected to a desired squeezing pressure. For example, if an operator cleaning a floor or other surface desires to ensure that the floor is substantially dry immediately following cleaning, the operator would utilize a cleaning pad which releases substantially all of the absorbed moisture (e.g. release about 95 percent of the absorbed moisture) when subjected to a pressure of about 20 pounds. Alternatively, a different cleaning pad 2 may be utilized at night when the operator cleaning the desired floor or other surface wishes to leave a residual amount of moisture on the floor to facilitate dissolving any remaining or hard to remove grease, soil, dirt, stain, etc., which is on the surface to be cleaned. In such instance, a super-absorbent polymer which is designed to release only a small amount of absorbed moisture (e.g. release only about 30 percent of the absorbed moisture) when subjected to a pressure of about 20 pounds utilized so that additional moisture is conveyed to and deposited on the surface to be cleaned. Once the additional moisture has been allowed to react and dissolve any remaining grease, dirt, soil, etc., on the surface to be cleaned, that surface can then be clean again with a new cleaning pad 2, e.g. a cleaning pad 2 which releases substantially all of the absorbed moisture (e.g. release about 95 percent of the absorbed moisture) when subjected to a pressure of about 20 pounds, to ensure that the floor is substantially dry immediately following cleaning.

Figure 4:
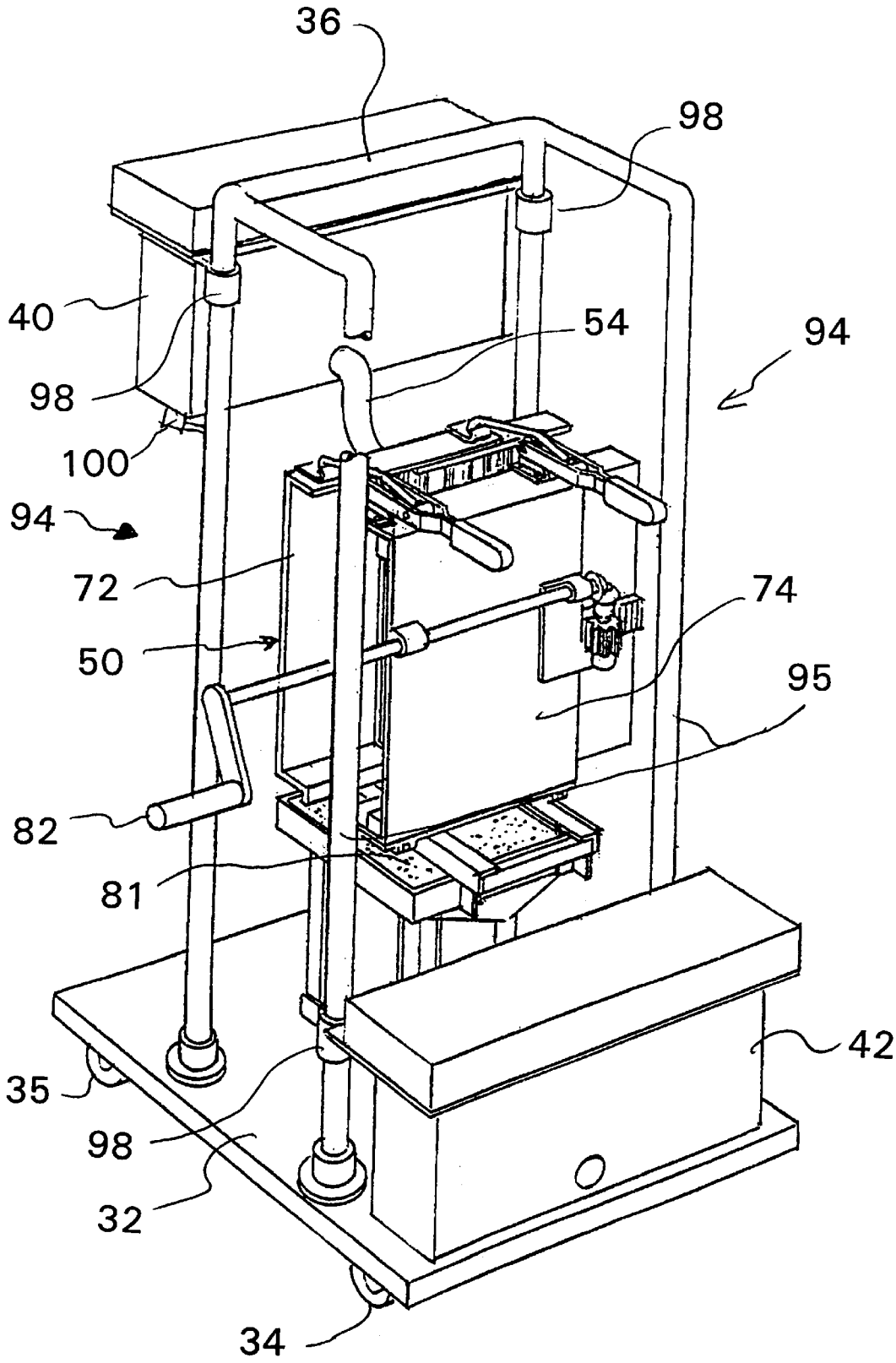
FIG. 4 is a diagrammatic perspective view showing a second embodiment of the collection/dispensing system according to the present invention.
Figure 5:
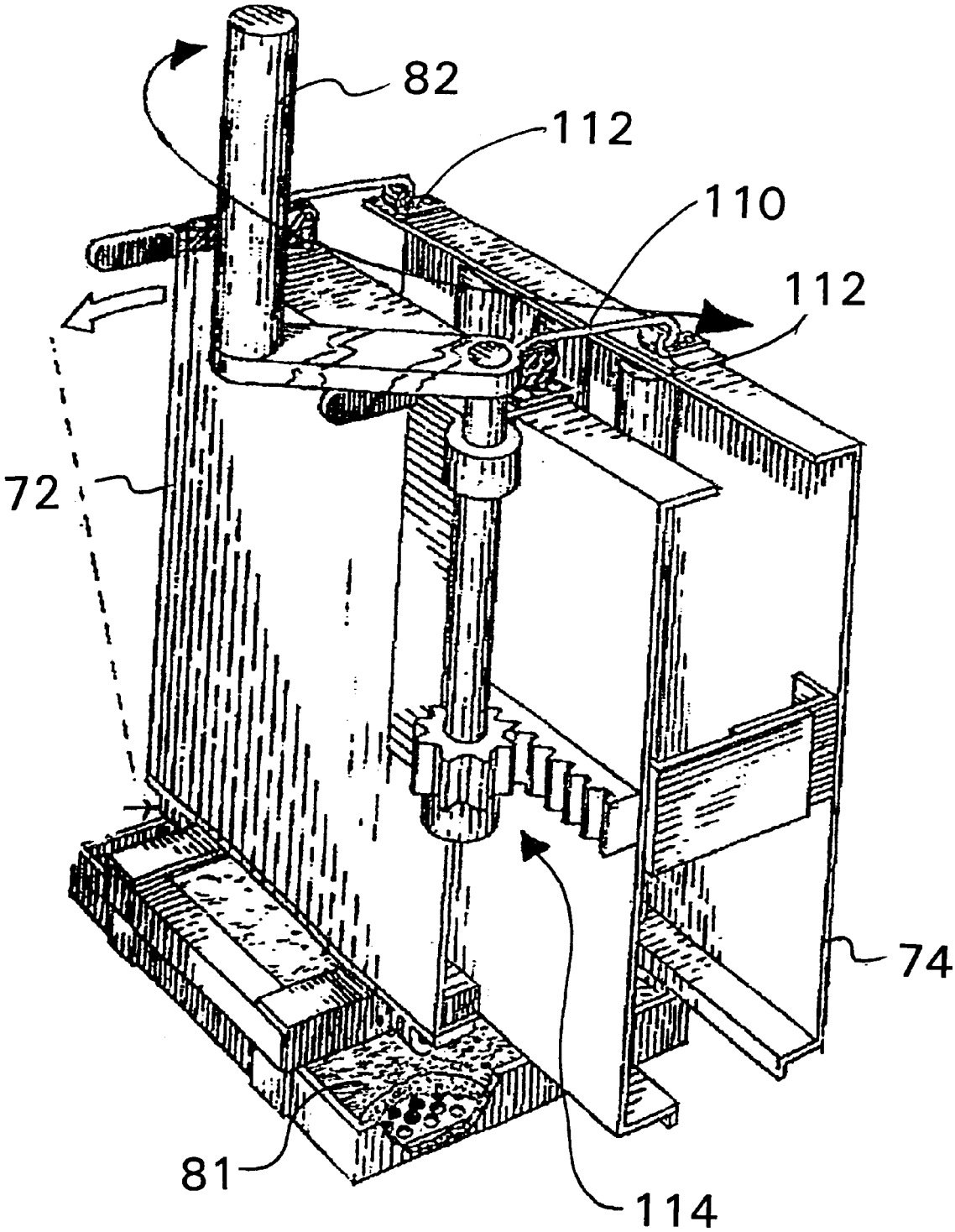
FIG. 5 is a diagrammatic perspective view showing a second embodiment of the wringing mechanism to the present invention.
Figure 6:
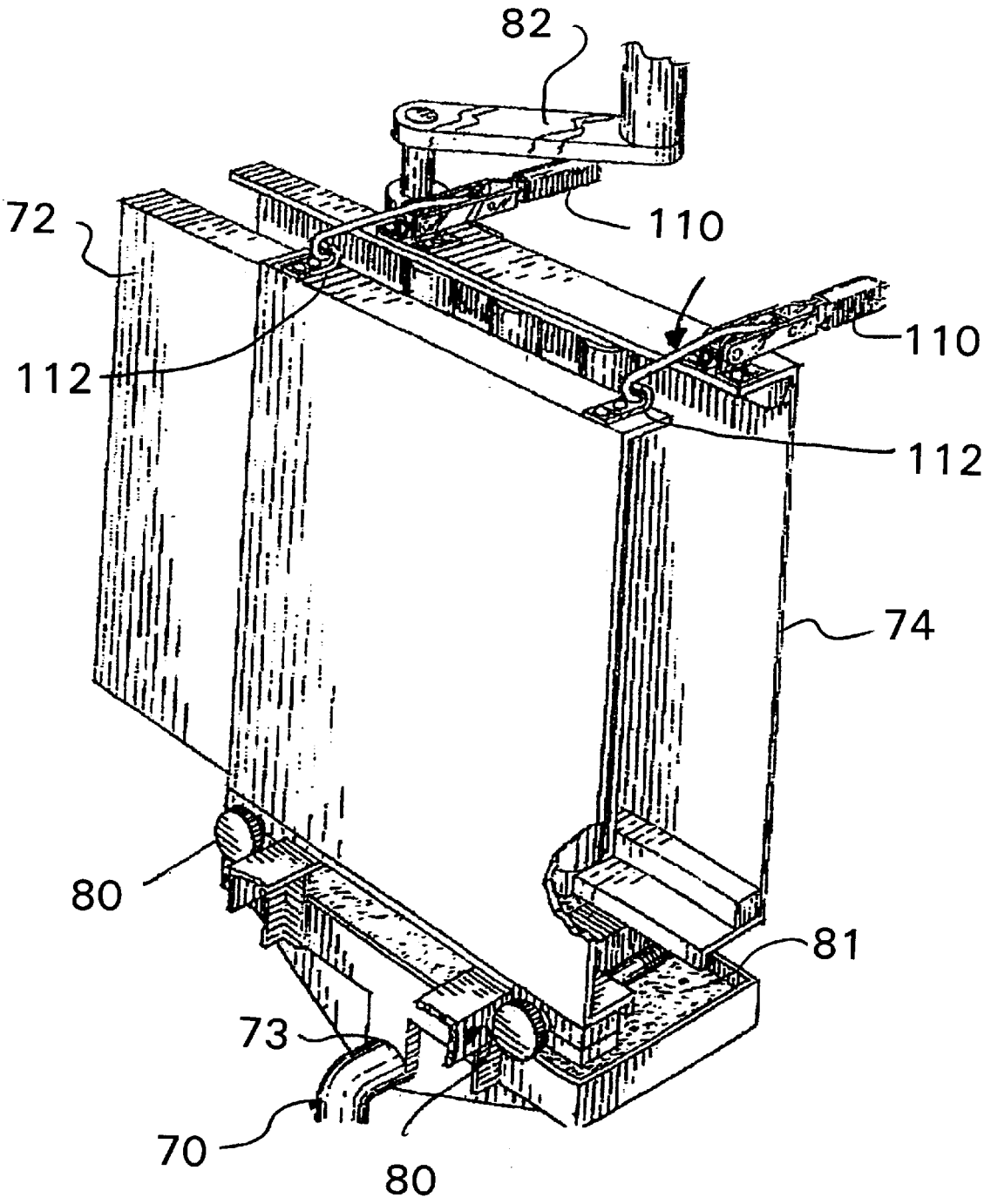
FIG. 6 is a diagrammatic perspective view showing on opposite side of the wringing mechanism of FIG. 5.

With reference now to FIGS. 4–6, a second embodiment of the present invention will now be discussed. As many of the same components are similar to those of the first embodiment, only a comprehensive discussion concerning the variations between the second embodiment and the first embodiment will be discussed in detail.

As with the first embodiment, a base framework 32 supports the cleaning/dispensing system 28. A pair of front and rear rollers or wheels 34, 35 as well as a transverse handle 36 facilitate manipulation of the cleaning/dispensing system 28 in similar manner to the first embodiment. In addition, a dust pan (not shown) may, if desired, be provided on the leading edge of the cleaning/dispensing system 28 to facilitate mopping of solids, materials, waste and debris, as with the first embodiment.

The major difference between this embodiment and the first embodiment is the arrangement of the dispensing container 40 and the collection container 42. According to this embodiment, the central framework 44 is eliminated and replaced with a pair of opposed vertical support members 94 comprising a pair of vertically extending shafts or poles 95. The wringer mechanism 50 is located centrally with respect to the base framework 32 and one of the pair of vertical support members 94 is positioned on a first side of the wringer mechanism 50 while the other of the pair of vertical support members 94 is located on the opposite side of the wringer mechanism 50. A first one of the pair of vertical support members 94 supports the dispensing container 40 while the second one of the vertical support members 94 supports the collection container 42. Each one of the containers 40, 42 is provided with a pair of cylindrical sleeves 98, with one sleeve being located on opposite sides of each one of each respective containers. Each one of the sleeves 98 encases and surrounds one of the shafts or poles 95 of the vertical support members 94. If desired, the sleeves 98 may be provided with roller bearings, or some other anti-friction surface, to assist with relative sliding motion between sleeve and the shafts or poles 95 to allow relatively unrestrictive to and fro movement of the container 40 or 42 along the vertical support members 94. A lower portion of each one of the containers is provided with a retractable pin 100, or some other conventional latching or locking mechanism, which engages with an aperture (not shown) provided in a vertically upper region of the shafts or poles 95, remote from the base framework 32, to lock the container 40 or 42 in an elevated position. When the operator retracts the pin from engagement with the aperture of the support shaft, this will facilitate lowering of the respective container 40 or 42 to a lowered position, while the opposite container 42 or 40 is raised from a lowered position to an elevated position. It is to be appreciated that during use, only one of the containers 40 or 42 will be an elevated position while the opposite container 42 or 40 will be in a lowered position.

The dispensing container 40 is initially coupled to an supply inlet, located in the upper region of the wringer mechanism 50, by a supply conduit 54 to facilitate conveying of the dispensing fluid from the dispensing container 40 to the wringing mechanism 50 to assist with cleaning, flushing, rinsing and/or wringing the cleaning pad 2 of the mopping assembly 12 when desired. Preferably, the valve is located at a connection between the remote end of the supply conduit 54 and the inlet coupling of the wringing mechanism 50 to facilitate the control of cleaning, flushing and/or rinsing fluid into the wringing mechanism 50 when desired by the operator. A lower region of the wringing mechanism 50 is provided with a discharge outlet which communicates, via a discharge conduit 70, with an inlet to the collection container 42. Both the supply conduit 54 and the drainage conduit 70 as well as the supply inlet and the discharge outlet of the wringing mechanism 50, all have mating thread sizes so that either one of the supply or drainage conduits 54 or 70 can be coupled to either one of the supply inlet or discharge outlet of the wringing mechanism 50 to facilitate either conveying fluid to or removing fluid from the wringing mechanism 50, depending upon the location of the respective container 40 or 42. For proper operation of the cleaning/dispensing system 28, the elevated container 40 or 42 is coupled to the supply inlet of the wringing mechanism 50 while the lowered container 42 or 40 is coupled to the discharge outlet of the wringing mechanism 50.

As with the previous embodiment, the wringing mechanism 50 has a separation chamber which has a planar filter which separates the separation chamber into an upper chamber and a lower chamber (not shown). The lower chamber communicates with the discharge outlet of the wringing mechanism 50 to convey fluid components to the collection container 42 while the upper chamber collects the solid debris and other waste resulting from the use of the cleaning/dispensing system 28.

It is to be appreciated that it is often necessary to change the fluid of the cleaning/dispensing system 28 and thus an operator should periodically check the filter 81 and empty the contents contained within the upper chamber when required. Such routine maintenance maximizes recycling and reuse of the liquid during operation of the cleaning/dispensing system 28.

During use of this embodiment of the cleaning/dispensing system 28, the operator will generally vertically lower the cleaning pad 2 of the mopping assembly 12 into the opening of the wringing mechanism 50 formed in the top region of the wringing mechanism 50 until the T-shaped head 16 is at least partially received within the wringing mechanism 50. Thereafter, the operator will operate the crank mechanism to supply sufficient wringing or squeezing pressure to the first and second pressure plates 72, 74. The first and second pressure plates 72, 74, in turn, exert a sufficient squeezing pressure on the cleaning pad 2 to squeeze or wring out a desired quantity of the absorbed dirt, liquid, grease, oil and/or debris which has been collected, by use of the mopping assembly 12 on the surface being cleaned.

While the wringing mechanism 50 is utilized by the operator, the operator will intermittently supply the washing, cleansing, and/or rinsing fluid from dispensing container 40 to wringing mechanism 50 via actuation of the hand brake 62 coupled to the valve at the supply inlet of the wringing mechanism 50. This fluid assists in cleaning and rinsing or wringing out any residual debris, oil, grease, etc. contained or remaining in the cleaning pad 2. If desired, the operator can wring and/or rinse the cleaning pad 2 a desired number of time or cycles to ensure that the cleaning pad 2 is sufficiently cleaned for its next cleaning cycle. Once the cleaning pad 2 has be sufficiently wrung, the operator will reverse operation of the crank mechanism 82 and such action will allow the springs to again bias the first and second pressure plates 72, 74 away from one another and thereby facilitate removal of the cleaning pad 2 of the mopping assembly 12 from the access opening of the wringing mechanism 50. Once the mopping assembly 12 has been adequately cleaned, the operation can then proceed with a further cleaning of the surface to be cleaned.

It is to be appreciated that either one or both of the container 40 or 42 can be provided with a small drainage duct, coupled to a lower portion thereof, while the opposite end thereof is coupled to either a conventional spray trigger mechanism to allow the operator to dispense additional cleaning fluid onto desired or heavily soiled areas of the surface being cleaned which may require additional cleaning fluid. Alternatively, a portable spray bottle (not shown), containing a desired quantity of fluid, may be supported by a conventional tray attached to the dispensing/cleaning system 28 of the present invention.

The wringing mechanism 50, according to this embodiment, comprises a first pressure plate 72 and a second pressure plate 74. The first pressure plate 72 supports a pair of levers 110 while the second pressure plate 74 supports a pair of latches 112. The levers 110, when engaged with the latches 112, facilitate drawing the first and second pressure plates toward one another to apply of biasing pressure on the cleaning pad 2, when located therebetween. A conventional hand crank 82 is utilized to operate a rack and pinion arrangement 114 to move the pressure plates 72, 74 to and fro horizontally with respect to the base framework 32. During such to and fro movement, the rollers exert a squeezing pressure on the cleaning pad 2 to apply a sufficient pressure to force the liquid, debris and other materials from the absorbent and non-absorbent material 4,6 and allow that liquid, debris and other materials to flow longitudinal along the drainage channels 8. The squeezed liquid, debris and other materials then falls, via gravity, on the filter 81 where the clean liquid is allowed to pass thereto while the solid debris and other contaminants are collected on a top surface of the filter 81.

The wringing mechanism 50 has a pair of guide tracks (not separately labeled) which allow guiding movement of the first and second plates 72, 74 when they move to and fro via operation of the crank mechanism 82. The free ends of the pressure pads 72, 74 adjacent the levers 110 are allowed to pivot with respect to the guide tracks to form an opening for receiving the cleaning pad 2 therebetween.

Since certain changes may be made in the above described improved dispensing/collection system and mopping assembly, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Wherefore, I claim:

1. A mopping system for facilitating mopping of a desired surface, the mopping system comprising:

a base framework supporting a fluid dispensing container and a fluid collection container;

a wringing mechanism being supported by the base framework, the manual wringing system being coupled to the fluid dispensing container to receive a cleaning fluid therefrom to facilitate cleaning of a mopping assembly when located within the wringing mechanism, and the wringing mechanism being coupled to the fluid collection container to convey collected fluid from the wringing mechanism to the collection container; and a filter being located, between the wringing mechanism and the collection container, to filter the fluid wrung from the mopping assembly prior to discharging the wrung fluid in the collection container.

2. The mopping system according to claim 1, wherein the mopping system includes a framework which supports both the collection container and the dispensing container, and the framework facilitates changing, when the collection container is substantially full of collected fluid, a position of the collection container and the dispensing container.

3. The mopping system according to claim 1, wherein a supply conduit couples the dispensing container with the wringing mechanism and a dispensing conduit couples the wringing mechanism with the collection container, and a flow valve controls the flow of fluid from the dispensing container with the wringing mechanism during the wringing procedure.

4. The mopping system according to claim 1, wherein the base framework is supported wheels and a handle is coupled to the base framework to facilitate manipulation of the mopping system.

5. The mopping system according to claim 4, wherein a supply conduit connects the collection container with the wringing mechanism and a drainage conduit connects the wringing mechanism with the collection container, and a valve is located in the supply conduit to control the flow of fluid from the dispensing container to the wringing mechanism.

6. The mopping system according to claim 5, wherein the valve is coupled to a remotely controlled actuation lever to facilitate remote actuation of the valve when desired.

7. The mopping system according to claim 1, wherein a releasable latching mechanism is supported by the base framework and the releasable latching mechanism, when engaged with the central framework, prevents relative movement between the central framework and the base framework, and, when the releasable latching mechanism is disengaged from the central framework, the releasable latching mechanism permits relative rotation of the central framework with respect to the base framework.

8. The mopping system according to claim 1, wherein a releasable latching mechanism is supported by at least one of the dispensing container and the collection container, and the releasable latching mechanism, when engaged with the central framework, prevents relative movement between the central framework and the base framework, and when the releasable latching mechanism is disengaged from the central framework, permits relative movement of the central framework with respect to the base framework.

9. The mopping system according to claim 1, wherein a wringing mechanism includes a perforated plate and the filter is located in a separation chamber, and the filter separates the separation chamber into an upper chamber and a lower chamber, and lower chamber communicates with the drainage conduit.

10. The mopping system according to claim 1, in combination of an elongate handle with a hand grip at one end and a cleaning pad located at the opposite end thereof, the cleaning pad comprising both a non-absorbent material and an absorbent material, and the absorbent material facilitates removing dirt and debris from the surface to be cleaned while the non-absorbent material facilitates removing absorbed liquid and debris from the cleaning pad during wringing of the cleaning pad.

11. The mopping system according to claim 10, wherein the cleaning pad has a plurality of drainage channels formed therein, and the draining channels are at least partially defined by the non-absorbent material.

12. The mopping system according to claim 11, wherein the end of the elongate handle, supporting the cleaning pad, has a T-shaped head which supports a plurality of support fingers, and the plurality of support fingers rigidly support the cleaning pad during use of the mopping assembly.

13. The mopping system according to claim 12, wherein the absorbent material engages with the plurality of support fingers to facilitate cleaning of a desired surface while the non-absorbent material overlies a space located between two adjacent support fingers, and the plurality of support fingers and the non-absorbent material define a plurality of drainage channels which facilitate removal of liquid and debris from the cleaning pad during a rinse procedure.

* * * * *